United States Patent [19]

Anderson

[11] 4,090,339

[45] May 23, 1978

[54] PREFORMED STRUCTURAL PANEL MEMBER

[76] Inventor: Ernest L. Anderson, 4606 148th Ave. NE., Bellevue, Wash. 98009

[21] Appl. No.: 657,473

[22] Filed: Feb. 12, 1976

Related U.S. Application Data

[63] Continuation-in-part of Ser. No. 192,601, Oct. 26, 1971, abandoned, which is a continuation of Ser. No. 823,590, May 12, 1969, abandoned.

[51] Int. Cl.[2] ..... E04C 2/38

[52] U.S. Cl. ..... 52/580; 52/406; 52/593; 52/624

[58] Field of Search ..... 52/580, 588, 582, 624, 52/625, 626, 629, 753 Y, 753 T, 406, 593, 595

[56] References Cited

U.S. PATENT DOCUMENTS

| | | | |
|---|---|---|---|
| 765,930 | 7/1904 | Mahony | 52/580 |
| 2,129,441 | 9/1938 | Otto | 52/90 |
| 2,394,443 | 2/1946 | Couignon, Jr. | 52/582 X |
| 2,453,326 | 11/1948 | Lambert | 52/593 X |
| 2,766,488 | 10/1956 | Danielson | 52/580 |
| 2,825,098 | 3/1958 | Hultquist | 52/580 |
| 3,113,401 | 12/1963 | Rose | 52/593 X |
| 3,300,899 | 1/1967 | Haws et al. | 52/580 X |
| 3,367,076 | 2/1968 | O'Brien | 52/394 |
| 3,529,393 | 9/1970 | Wilkins | 52/282 X |
| 3,557,510 | 1/1971 | Woodling | 52/625 |
| 3,699,736 | 10/1972 | Wallace | 52/595 |

FOREIGN PATENT DOCUMENTS

| | | | |
|---|---|---|---|
| 1,067,536 | 6/1954 | France | 52/593 |
| 600,772 | 4/1948 | United Kingdom | 52/595 |
| 349,130 | 5/1931 | United Kingdom | 52/593 |

*Primary Examiner*—Leslie Braun
*Attorney, Agent, or Firm*—Seed, Berry, Vernon & Baynham

[57] ABSTRACT

Spaced, opposed plywood sheets having kerfs in their peripheral edges are integrally joined by S-shaped aluminum bars that join the edges of the plywood sheets to form panels. Each bar is provided with spaced, elongated splines that interfit into the kerfs and are adhesively bonded therein. The bars are welded together to form an integral border frame. Each S-shaped bar includes an outwardly facing groove or protrusion and a duct joined by a common wall. The top bar and one side bar of the border frame are turned end for end relative to the bottom and opposite side bars so that the duct of a bar forming a border frame of an adjacent panel will interfit into the groove of the bar forming the border frame of the first panel. In this manner a continuous wall of interfitting panels may be constructed. Various forms of bars are provided to interconnect other building components such as beams, windows, doors and the like, with the panels. Also described is a beam formed of two or more load bearing members each having lengthwise kerfs along their opposite edges. The load-bearing members are joined by a pair of elongated aluminum bars also having integral splines which are adhesively bonded in the kerfs.

The interconnectable border frames with protrusions and grooves are also provided in an improved wooden form for panels which can be combined to form the essential roof, walls, and floor components of a complete building. The floor and wall panels uniquely provide for selectivity in the location of the floor panels along the vertical height of the wall panels.

4 Claims, 28 Drawing Figures

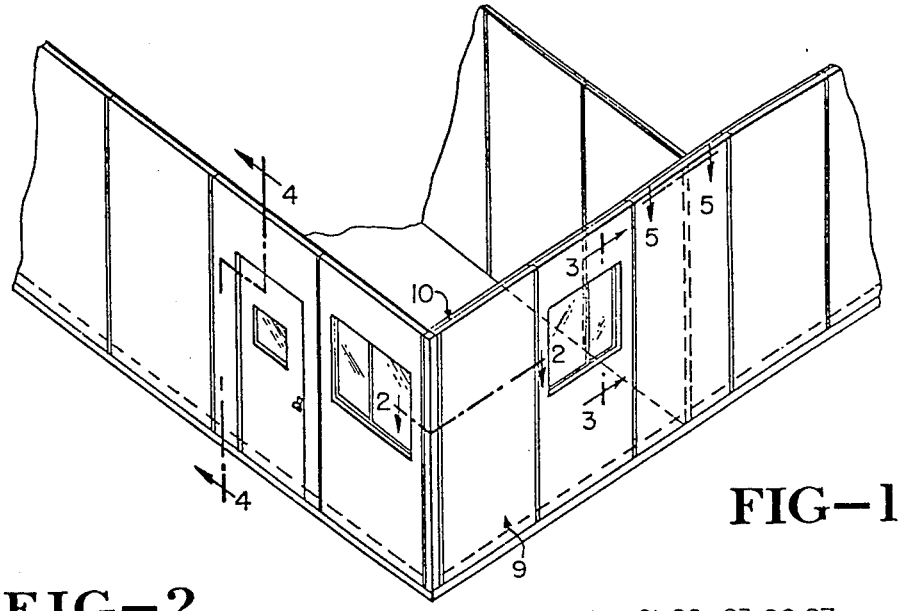
FIG-1
FIG-2
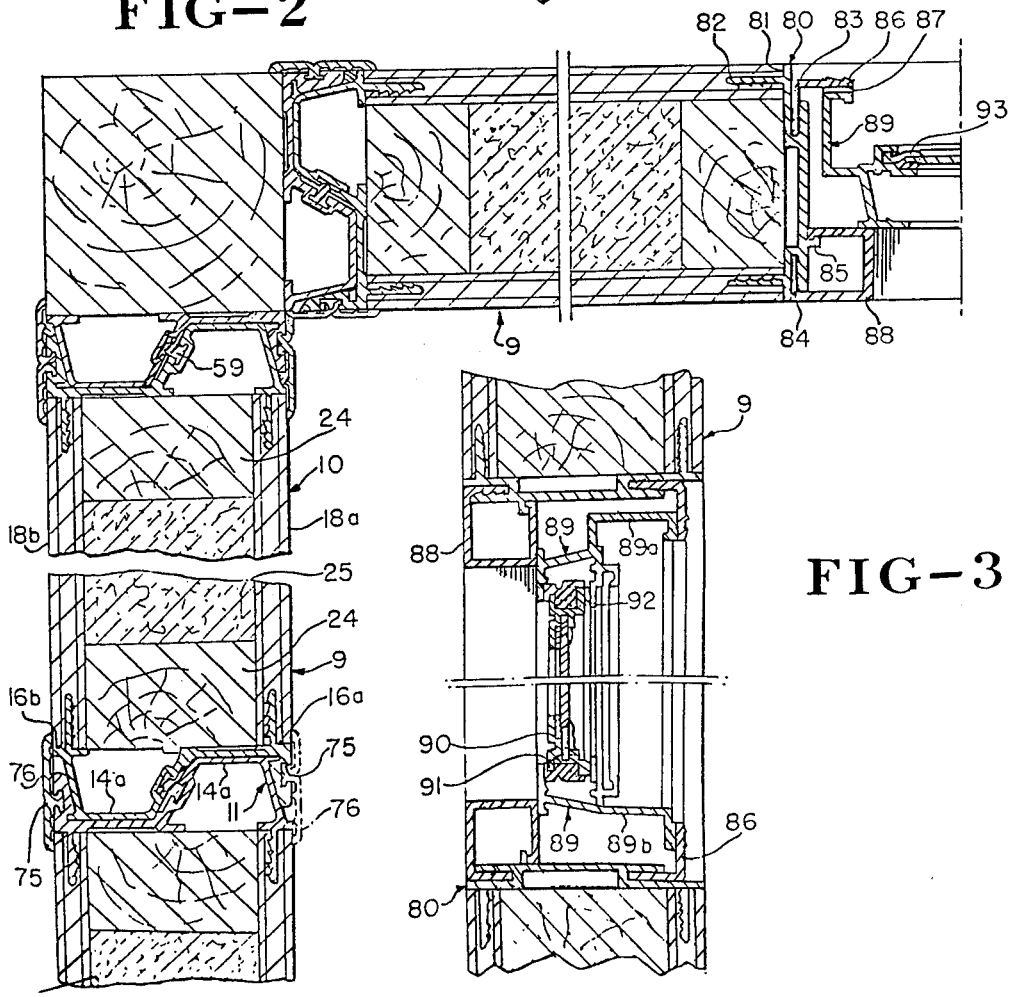
FIG-3

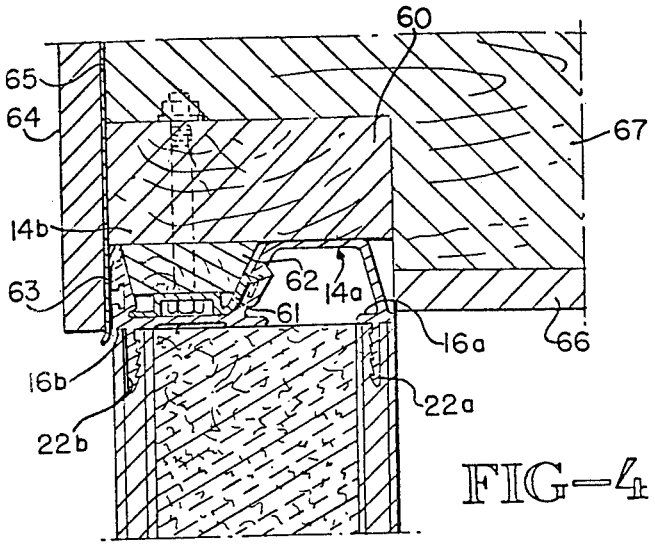
FIG—4
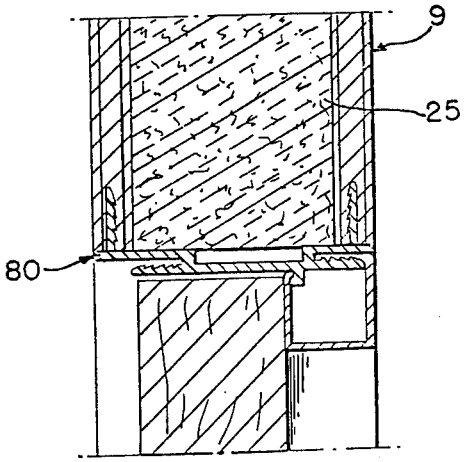
FIG—6
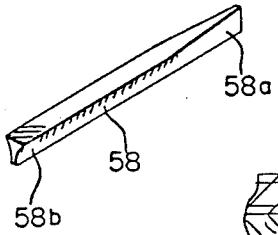
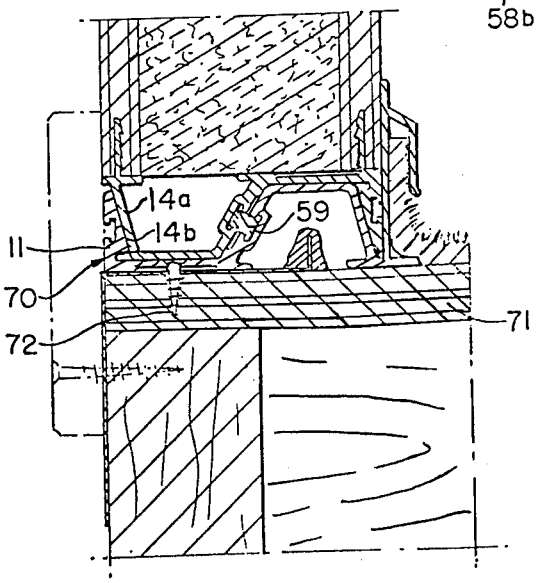
FIG—5
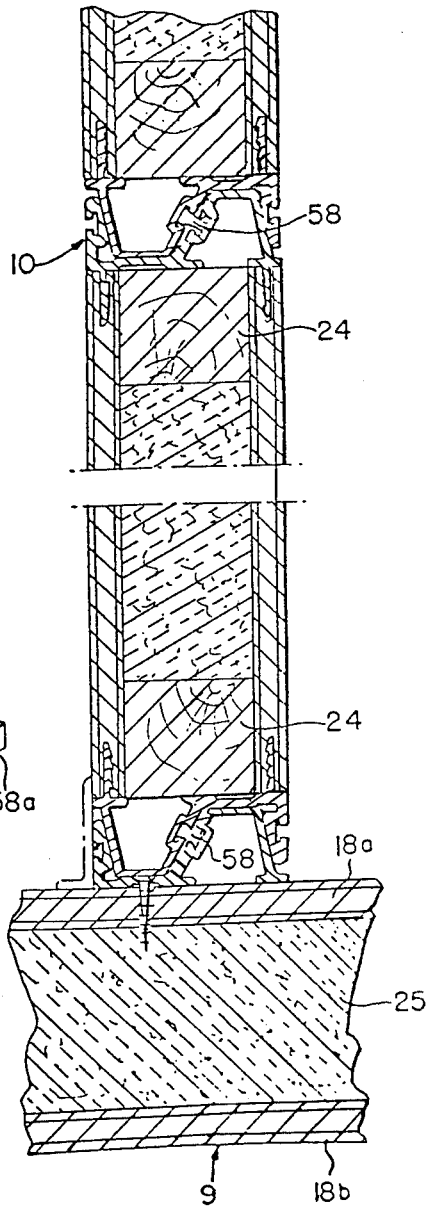

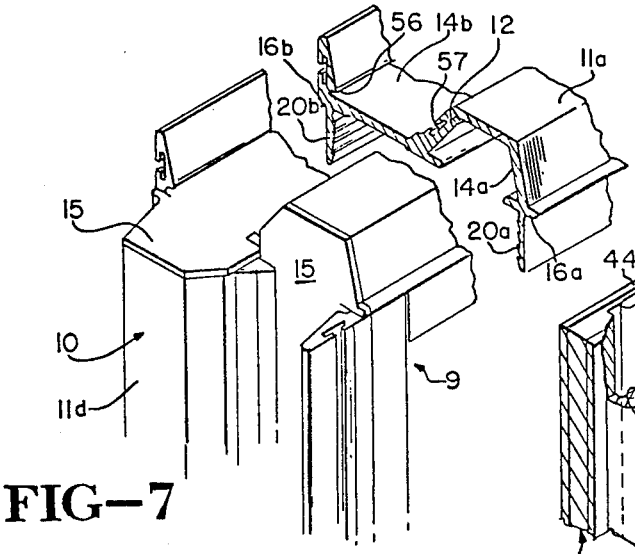
FIG—7
FIG—8
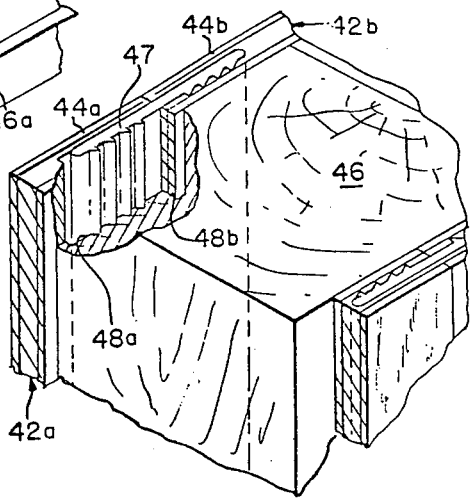
FIG—9
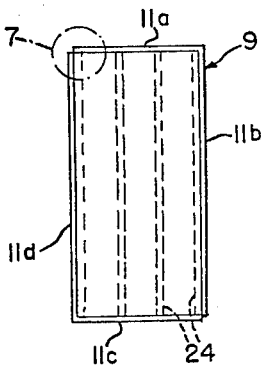
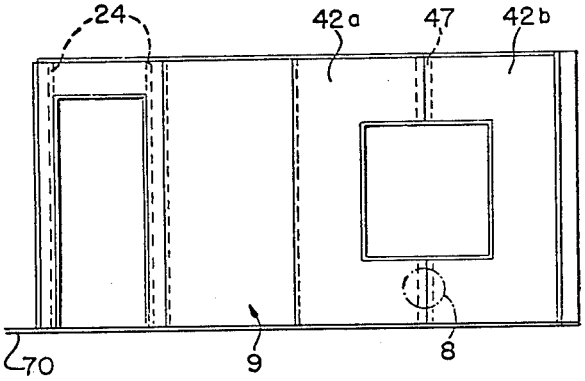
FIG—10
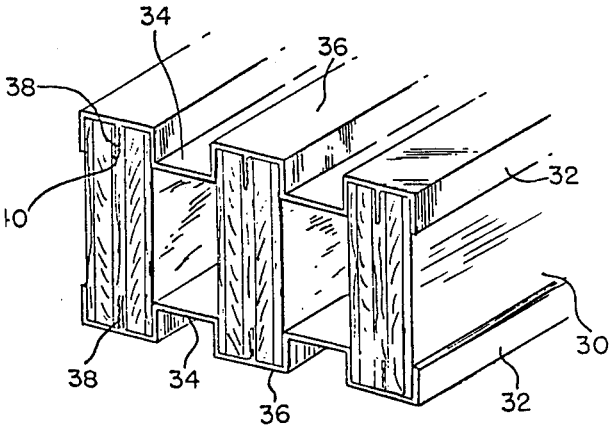
FIG—11

FIG. 12
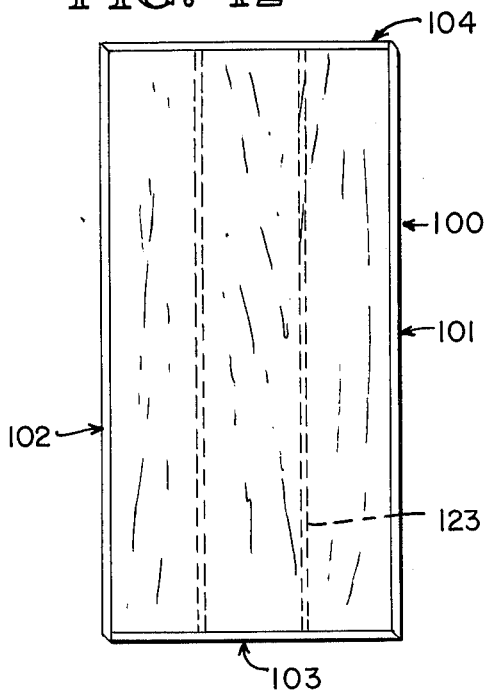
FIG. 13
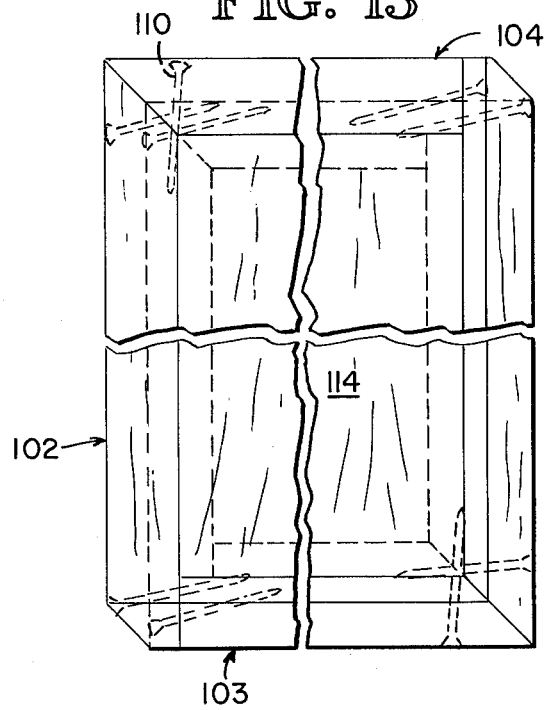
FIG. 14UL
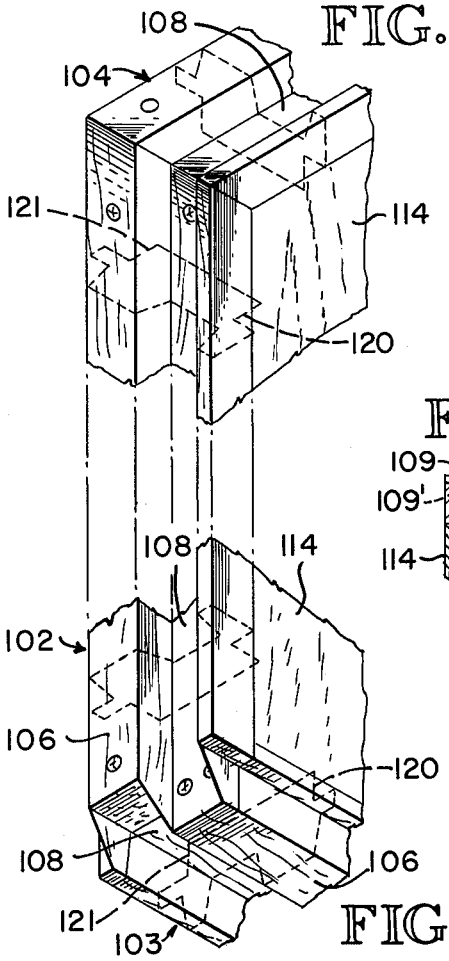
FIG. 14UR
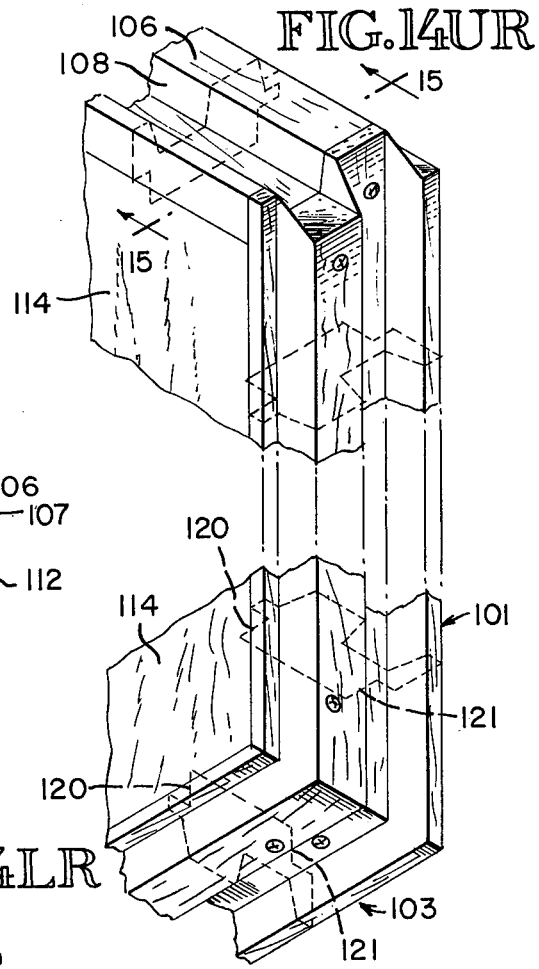
FIG. 15
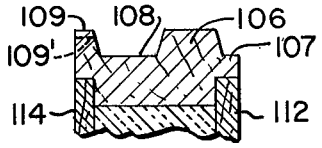
FIG. 14LR
FIG. 14LL FIG. 18
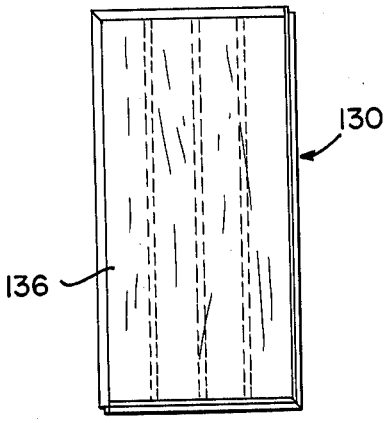
FIG. 20
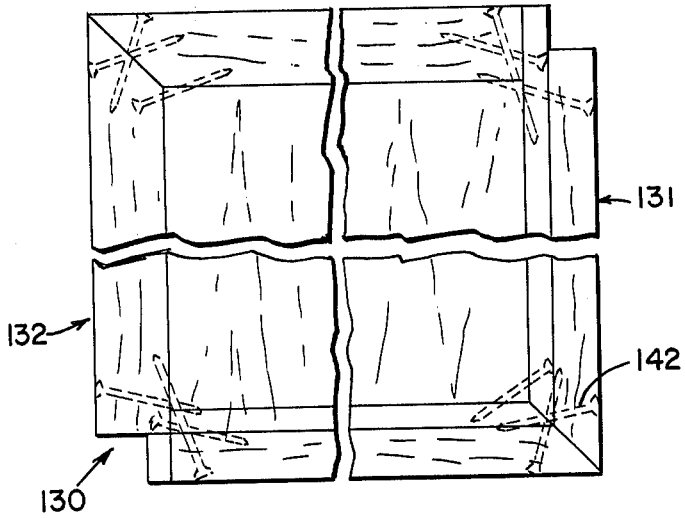
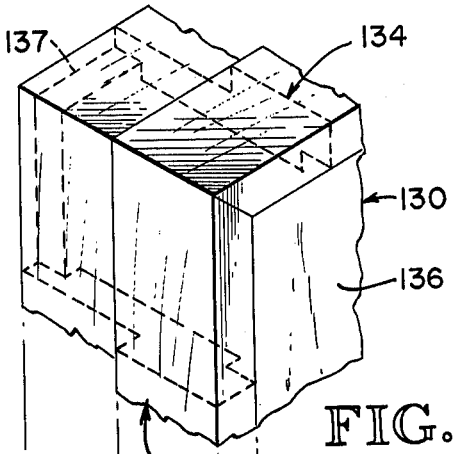
FIG. 19UL
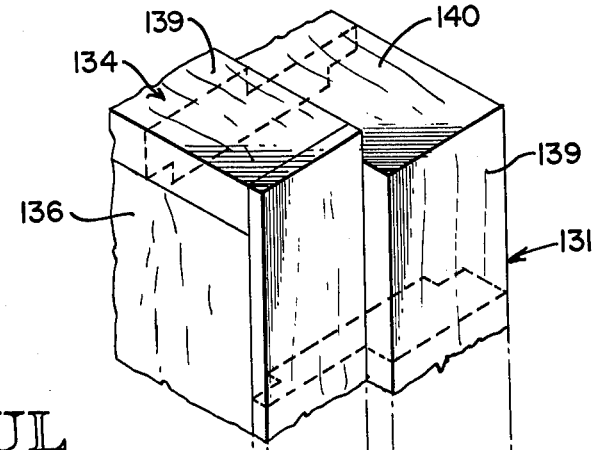
FIG. 19UR
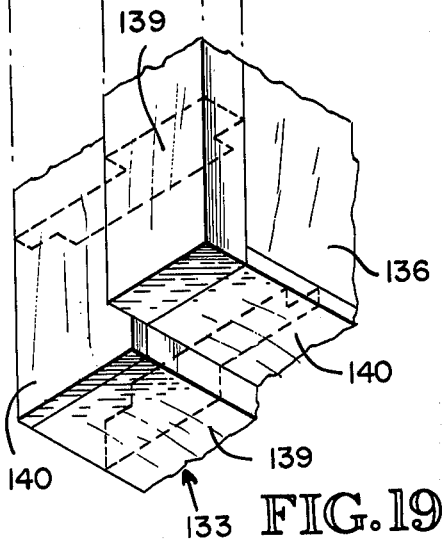
FIG. 19LL
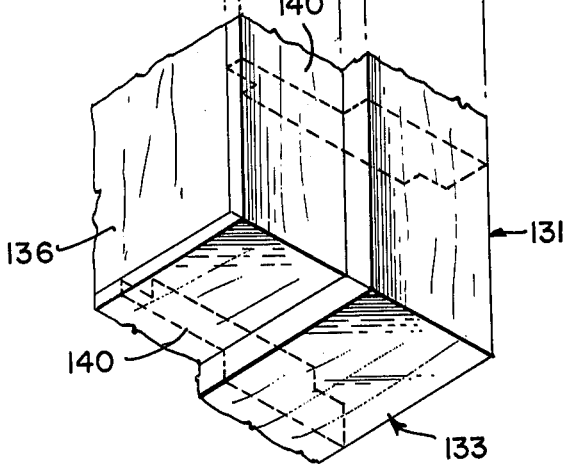
FIG. 19LR

PREFORMED STRUCTURAL PANEL MEMBER

CROSS-REFERENCE TO RELATED APPLICATION

This application is a continuation-in-part of application Ser. No. 192,601 filed Oct. 26, 1971, now abandoned which is a streamlined continuation of application Ser. No. 823,590, filed May 12, 1969, now abandoned.

BACKGROUND OF THE INVENTION

1. Field of the Invention

The present invention relates to preformed structural members and, more particularly, to load-bearing preformed structural members, such as modular wall, roof and floor panels which interfit to provide a self-supporting wall, load-supporting walls, roofs and floors, and to beam members used with or separate from the panels.

2. Description of the Prior Art

Heretofore, preformed modular panels have generally consisted of two opposed lightweight facing materials joined by equally lightweight border frames. The structural strength necessary to support the roof of the building made from such preformed panels was developed solely from the high-strength posts and beams. Panels, in general, were thus used solely for weatherproofing or for internal partitioning. In addition, prior art modular panels have been difficult to assemble into complete buildings.

Heretofore, beams, trusses and the like, have generally consisted of either a single piece of high strength structural material or multi-piece laminated structural members.

SUMMARY OF THE INVENTION

This invention provides a preformed structural member, primarily a modular panel of various embodied forms, which has sufficient internal strength to bear loads normally borne by posts and beams made of high-strength materials. This internal strength is derived from the integral interconnection of surface materials (in the case of panels) or elongated load-supporting members (in the case of beams) with higher strength frame members. The frame members in one embodiment (hereinafter first embodiment) have spaced integral protrusions that are inserted into the kerfs in the surface materials or load-supporting members. In the case of a panel the frame members form an integral border frame surrounding the peripheral edges of the surface materials. In the case of the beam the frame members need join only the upper and lower edges of the load-supporting members. In both cases the protrusions of the frame members are adhesively bonded in the kerfs.

An important general object of all embodiments of the invention is to provide a panel which has a rigid border frame joining spaced surface sheets such as to form a panel of much greater strength than the frame members or sheets would have if used individually in conventional construction.

A further object of the first embodiment panel of the invention is to provide preformed, load-bearing wall panels which interfit with adjacent wall panels and which may be joined on the job site without the need of special tools or skills.

Another object of the first and second embodiment panels is to provide a preformed wall panel that contains accessory components, such as windows or doors, which are connected to the wall panels by framing members that function additionally to join the surface sheets of the panel and which are especially adapted to permit installation of the component at the construction site.

Still another object is to provide various frame members that may join two or more surface sheets or load-bearing members together and may support various components of a building.

Still a further object of all embodiments of the panels is to provide a panel which is sealed and whose elements are sealed for weather integrity so that it can be erected at the job site under adverse moisture conditions and does not require further weather resisting siding and the like. In addition, the sealed construction restricts movement of moisture and heat into the panels and through the panels both from outside the building as well as from human or animal generated heat and moisture from within the building.

It is an important feature that the border frame has a spline or a notch in abutting contact with the plywood face sheets to provide resistance to shearing of the plywood as well as to the loading in the plane of the sheets.

Still another feature is to provide for balloon construction by the use of the floor and wall panels which allows positioning floors vertically offset from the lower ends of side wall panels for ceiling height flexibility.

Still another object of all embodiments of the panels is to provide preformed panels which will interfit with like panels placed side-by-side or end-for-end and which are weather-sealed at the joint.

Another object is to provide structural floor and roof panels that interfit end-for-end or side-for-side and which can be assembled at the construction site without the need for special skills or tools.

An object is also to provide a beam, truss or the like structural member that is simple and inexpensive to fabricate at a manufacturing facility and yet is of much greater strength that the components used in making up the beam or truss if used individually in conventional construction techniques.

BRIEF DESCRIPTION OF THE DRAWINGS

FIG. 1 is a fragmentary isometric of a house made from preformed first embodiment panels embodying the principles of the invention.

FIG. 2 is a horizontal section taken along the line 2—2 of FIG. 1 and turned 90° relative to the section line.

FIG. 3 is a vertical section taken along the line 3—3 of FIG. 1.

FIG. 4 is a vertical section taken along the line 4—4 of FIG. 1.

FIG. 5 is a horizontal section taken along the line 5—5 of FIG. 1.

FIG. 6 is an isometric of a key employed to lock adjacent first embodiment panels together.

FIG. 7 is a fragmentary isometric taken at the circled corner of FIG. 9 illustrating the relationship of bars turned end-to-end of a border frame to provide the interfitting relationship of adjacent first embodiment panels and showing one such bar in section.

FIG. 8 is an isometric taken at the circled area of FIG. 10 and with a portion broken away for clarity of a pair of panels joined by a modified form of fastener.

FIG. 9 is a typical panel shown in side elevation.

FIG. 10 is a side elevation of several typical first embodiment panels interfitted together.

FIG. 11 is an isometric of a beam embodying the principles of the invention.

FIG. 12 is a front elevation of an improved wall panel designated as a second embodiment of the invention.

FIG. 13 is an enlarged front elevation of the second embodiment panel.

FIGS. 14 are fragmentary isometric corner views of the second embodiment wall panel. FIG. 14UL is the upper-left corner; FIG. 14LL is the lower-left corner; FIG. 14UR is the upper-right corner; FIG. 14LR is the lower-right corner.

FIG. 15 is a transverse section taken along the line 15—15 of FIG. 14UR.

FIG. 18 is a front elevation of a floor or roof panel and designated as a third embodiment panel of this invention.

FIGS. 19 are fragmentary isometric corner views of the third embodiment panel. FIG. 19UL is an upper-left corner; FIG. 19LL is a lower-left corner; FIG. 19UR is an upper-right corner; FIG. 19LR is a lower-right corner.

FIG. 20 is an enlarged front elevation of the third embodiment panel.

DESCRIPTION OF THE PREFERRED EMBODIMENT

Figure 16:
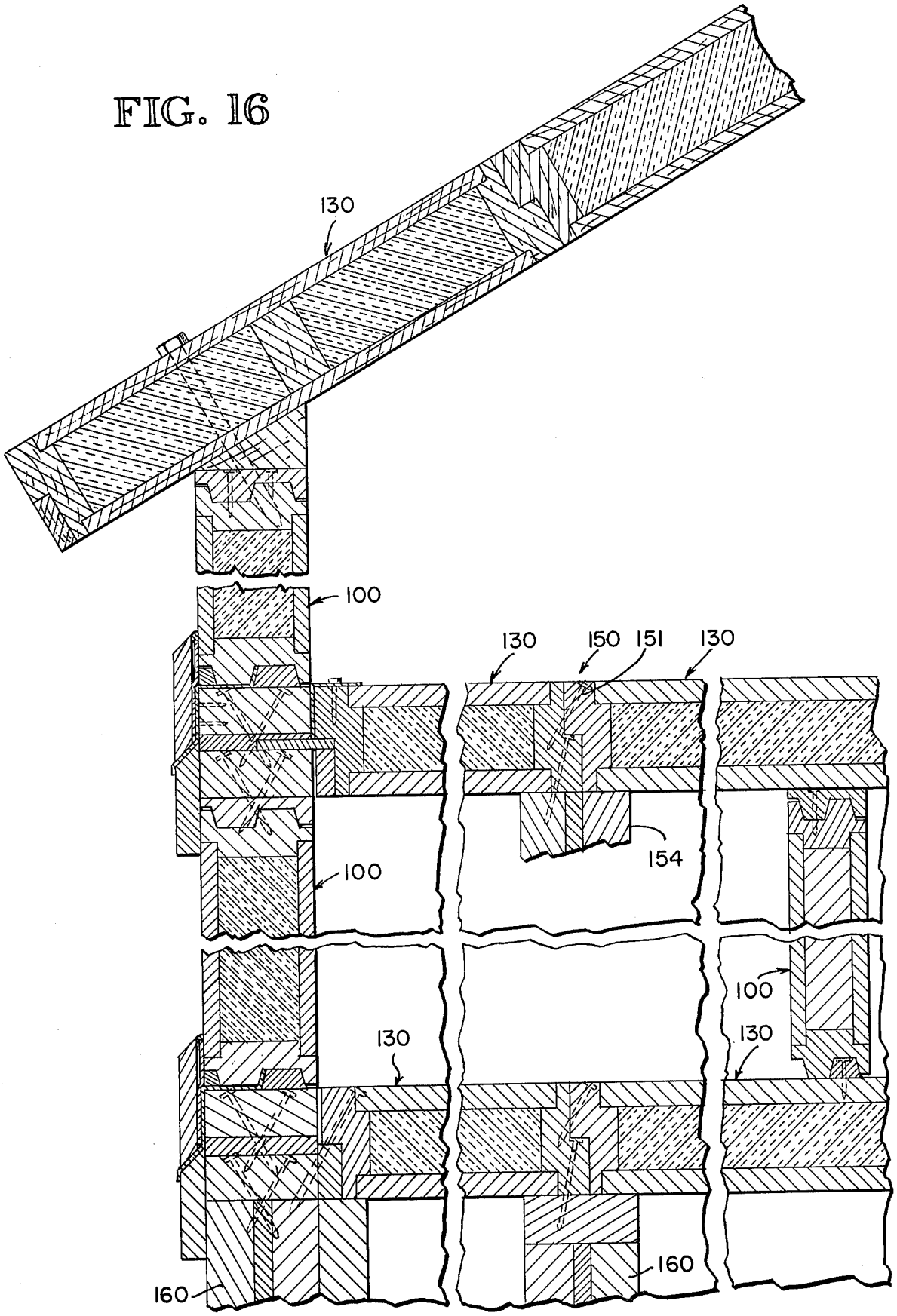
FIG. 16 is a vertical section of a typical building constructed of second and third embodiment panels of this invention.

Referring to the drawings it is seen that a typical first embodiment wall panel unit 9 of the present invention has a rigid continuous border frame 10 preferably of extruded aluminum frame bars 11. Other easily formed materials of adequate strength rather than aluminum may also be used. The frame bars 11 making up the border frame 10 are welded together at their corners and comprise a top side bar 11*a* (as viewed in FIG. 9) a right side bar or jamb 11*b*, a bottom side bar 11*c*, and a left-hand side bar 11*d*. Each is S-shaped in transverse cross section (see FIG. 7) and includes a common wall 12 joining two oppositely directed channels 14*a* and 14*b*. The bar will always be mounted on a panel with one of the channels facing the panel and thus closed. This channel will be called the rib, protrusion or duct 14*a*. The other channel will thus face outwardly from the panel and will be called the groove 14*b*. The top and side bars 11*a* and 11*b*, respectively, for each panel have their ducts and grooves aligned as shown, for example, with the ducts adjacent the forward face of the panel as in FIG. 9. The bottom and side bars 11*c* and 11*d*, respectively are turned end-for-end opposite to the bars 11*a* and 11*b* so that the ducts of the bars 11*c* and 11*d* are adjacent the rear face of the panel as shown again, for example, in FIG. 9 and in FIG. 7. The ends of each bar 11 are cut back leaving a tongue 15 which overlies and closes the duct of a joined bar. As is readily apparent the frame bars 11 of adjacent panels are interfitted one within the other with similar ducts and grooves of adjacent panels aligned with one another. A row of such panels provides a wall having a continuous groove running along the top and bottom thereof. The ducts may be made continuous by eliminating the tongues of the vertical bars. A continuous duct may then be used to run concealed electrical conduit or the like throughout the building.

An important aspect of the first embodiment panel of this invention is the technique of developing structural strength by uniting the aluminum bars 11 with surface materials, in the preferred embodiment three-eighth inch plywood sheets 18*a* and 18*b*. It should be understood, of course, that neither the aluminum bars nor the plywood sheets in and of themselves are particularly high strength when used individually following conventional construction techniques. For the purpose of uniting the bars 11 with the plywood sheets each bar is provided with spaced, coplanar bearing surfaces 16*a* and 16*b* which abut against the edges of interior and exterior plywood surface sheets 18*a* and 18*b*, respectively. The interior and exterior designations apply only to the panels being used to construct an external building wall but they will be used for all opposite surface sheets for the purpose of this description. Depending from the bearing surfaces 16*a* and 16*b* are toothed splines 20*a* and 20*b*, respectively. The splines extend the length of the bars 11 except for foreshortened ends of alternate bars as when forming a corner as shown, for example, in FIG. 7. The splines are wedged within peripheral kerfs in the sheets 22*a* and 22*b* and hold the sheets tightly in parallel alignment. With the splines of all of the side bars 11*a*—11*b* secured within kerfs and the corners of the bars welded together to form the border frame 10 a strong load-bearing panel is formed. To strengthen the joint between the splines and the sheets an adhesive, compatible with the aluminum and plywood, is added in the kerfs prior to inserting the splines. A suitable adhesive for this purpose is a contact cement manufactured by the 3-M Company of St. Paul, Minnesota under the product designation 4518. Other suitable adhesives, however, may also be employed. To add still further strength to the assembled panels, spacers, such as four vertical wooden studs 24, are bonded between the two joined sheets of the panel. In the preferred form of panel, and as best shown in dotted lines in FIG. 9, a stud is positioned close to each set of sheet vertical edges and two additional studs are bonded equidistantly between the vertical edges. The exact position of these studs within the panel is not critical. In some cases where doors or windows are incorporated into the panel (FIG. 10) the studs may be positioned closer to the door or window frame than to the edges of the panel. In this manner the inherent strength of the panel is supplemented at the points of greatest stress. The void between the sheets is preferably filled with a flame-retardant, insulating material 25 to eliminate the need for further insulation as employed with conventional construction.

The panel 9 as thus formed is weather-tight and of extremely high strength in both compression and tension loading. In actual load tests of a typical 4×8 panel constructed according to the foregoing a total load of 45,000 lbs. was sustained without failure and upon unloading the panel returned to its original length plus or minus 0.008 inches. This provides a loading capability several times greater than is normally required for a load-bearing wall unit.

The concept of deriving high strength from the integral union of individual lower strength members is also applicable to structural forms other than panels. A beam, for example, as shown in FIG. 11, is such a form. The beam illustrated includes three, although two or a greater number may be used, elongated wood surface materials or load-bearing members 30 integrally joined by a pair of aluminum bars 32. Each of the bars is provided with spacing webs 34 which abut against the opposed faces of the plywood members and load-bearing surfaces 36. Splines 38, identical with the splines 22*a* and 22*b* earlier described, extend from the load-bearing surfaces 36 into lengthwise kerfs 40. Materials other than plywood may also be joined in this manner. Furthermore, it is not necessary that the sheets be spaced. The spacing does improve the tension and strength capabilities of the beam by increasing its width.

Another important feature of the invention is employed to directly join two abutting sheets of plywood or the like and is best illustrated in FIG. 8. Two panels 42*a* and 42*b*, each including facing sheets 44*a* and 44*b* of plywood or the like are joined with the edges of the sheets abutting. A vertical stud 46 is provided at the joint and overlays the vertical edges of the sheets. Double ended splines 47 are positioned in opposed kerfs 48*a* and 48*b* to join the sheets. Adhesive is applied in the kerfs and between the abutting edges to further strengthen the joint. Such a technique is advantageously employed in joining two 4×8 panels to make an 8×8 panel as best shown for example in FIG. 10.

Having described the basic principles of the first embodiment of the invention, the versatility for use in new building techniques will now be described. The common wall 12 of each frame bar 11 is provided with a retainer slot 56 and a locking slot 57. The locking slot faces outwardly into the groove 14*b* of the bar. As is best shown in FIG. 5 the interfitted bars of adjacent panel members are wedged together and locked by a key 58 which is shown in isometric form in FIG. 6. The key has a taper 58*a* and sharp edges 58*b* to firmly seat itself in the slot. To install the key the workman need only position it into the mating locking slots of adjacent panels and drive it in with a light tap from a hammer. As the wall is free-standing the adjacent panels are secured together with keys at the top and bottom of the vertical joint and between the bottom side bar 11*c* and the base channel to be described. For the sill and vertical joints of the panels a seal is provided by a vinyl bead 59 squeezed into the opposed locking slots 57 and caulking is applied around the keys 58. To join a header 60 to a panel 9 an aluminum header lock strip 61 is first bolted through an elongated receiving block 62 to the header. The lock strip 61 snaps into the locking slot 57 and the retainer slot 56. A caulking bead 63 is applied to the gap formed along the edge end of the channel 14*b* and the header to provide a weather-tight seal. The roof line is completed in a conventional manner with a fascia strip 64, a vapor barrier 65, a ceiling 66 and joists 67. A seal such as a vinyl bead may also be provided in the locking slot 57 of the top bar 11*a* if desired.

The preferred construction for the base channel 70 upon which the panels rest is best shown in FIGS. 4 and 10 and includes an aluminum frame bar 11, as earlier described, that is secured to the floor 71 as by screws or the like 72. The duct 14*a* of the bottom side 11*c* of the panel border frame 10 is inter-fitted into the groove 14*b* of the frame bar of the base channel 70. A vinyl bead seal 59 is added in the locking slots 57, as mentioned earlier, to provide a weathertight joint.

As best shown in FIG. 10 the panels 9 or 42*a* and 42*b* are positioned into the wall by locking adjacent panels together and then locking them to the base channel 70. Retainer slots 75 (FIG. 2) are provided in the outer faces of the channels 14*b* of the bars 11 making up the wall. Thus retainer slots will be exposed, for example, on both sides of the wall at the vertical joints between adjacent panels. The retainer slots 75 are provided to hold snap-in vinyl trim strips 76 which may be used if it is desired to cover the joint between two adjacent panels. The vinyl strip is optional, however, and since contemporary decorating techniques advantageously use the joint lines of two adjacent panels as part of the decorative trim, the vinyl strips are often not specified in a particular house. Of course, if desired, conventional siding may also be applied to the exterior wall of the house.

Another advantageous feature of the invention is that window and door framing and the like is easily and quickly incorporated into a particular panel 9 or between two abutting panels 42*a* and 42*b* with the use of novel aluminum framing bars. These framing bars are designed to perform particular functions but, in addition, will always embody the splines and bearing surfaces similar to the bar 11 so that structural integrity of the panel is maintained. A typical window framing unit is shown in FIGS. 2 and 3 and includes a window framing bar 80 with bearing surfaces 81 and splines 82 similar in design and function to their corresponding parts in the bar 11. Window framing bar 80, however, is provided with oppositely facing, serrated grooves 83 and 84 and a tab 85. Positioned in the outer serrated groove 83 is a trim and locking angle 86. One end of the angle is secured within the serrated groove 83 with the other end having a sealing tape 87 secured thereto. A backstop member 88 is snapped into the inner serrated groove 84 and the tab 85. Mounted between the backstop 88 and angle 86 and abutting the sealing tape 87 is a window frame 89. The window framing bar 80, backstop 88, trim and locking angle 86, and window frame 89 are continuous around the perimeter of the window. The window frame 89 includes a web 89*a* that is reversed at the sill of the window as indicated at 89*b* in FIG. 3. A sliding vent 90 having a nylon guide 91 and a weather strip 92 is slidably positioned in the top and bottom of window frame 89. The remaining portion of the window is conventional in structure and includes a fixed vent 93 that is sealed within the window frame 89.

One feature adding to the versatility of a building made from the panels 9 is that a bottom channel 70 for an interior wall may be secured to the floor in which case the floor covering stops adjacent the bottom channel, or the bottom channel (or a receiving block) may be placed directly on a continuous floor covering so that it may extend between adjoining rooms. In the latter case the position of the interior walls may be changed to suit the home owner without interrupting the pattern of the floor covering.

A now preferred second embodiment panel of the invention is illustrated in FIGS. 12–15. As in the first embodiment earlier described, the panel 100 includes side rails 101 and 102 and end rails 103 and 104. The end rails are turned end-for-end relative to one another as are the side rails. Each rail has an identical transverse cross section. This cross section is best illustrated in FIG. 15 and includes a protrusion 106 which extends the length of the rail and an adjacent recess or groove 108. The side walls of the protrusion and groove have complementary tapers and the outer side walls of the protrusion and groove merge with a horizontal ledge 107 and shoulder 109, respectively. As indicated by the dotted line 109' in FIG. 15, it is preferred to have the shoulder 109 at a level spaced slightly from the head wall of the protrusion to give clearance between the ledge 107 and shoulder 109 of adjoining panels as can be seen in FIG. 16.

The views 14UL, 14LL, 14UR, 14LR representing upper-left, lower-left, upper-right and lower-right corners are shown in isometric, 45° out of their actual positions, in order to illustrate the detail of the intersection of the end rails and the side rails. As best shown in FIGS. 14UR and 14LR, the protrusion 106 of the right-hand side rail 101 extends a shorter lengthwise distance than the adjacent recess or groove 108. The reason for this is to allow the end of the protrusion 106 in side rail 101 to form a continuation of the recess 108 of the end rail 104. Similarly, the recess 108 of side rail 101 extends beyond the protusion 106 and ends flush with the protrusion 106 of the end rail 104. As best shown in FIGS. 14UL and 14LL, the protusion 106 of side rail 102 extends lengthwise toward the lower left-hand corner of the panel a shorter distance than the recess 108 in the rail 102 (FIG. 14LL). Thus the lengthened recess 108 in the side rail 102 terminates flush with the protrusion 106 of the end rail 103 and the protrusion 106 of the side rail 102 is shortened to terminate flush and form a continuation of the recess 108 of the end rail 103.

Screws 110, or other suitable fasteners, hold the side rails and end rails together along with staples, not shown, which secure the face sheets 112 and 114 to the rails. In addition, the face sheets and rails can be bonded together in weather-tight integrity to form the structural integral panel. That is, the panel is a structural entity in itself, a load supporting component of the total building, as in the earlier described first embodiment suitable to be used and is used as a substitute for studs, posts and the like. An important aspect, like in the first embodiment panel, is that the rotation of end rails end-for-end and the end-for-end rotation of the side rails provides a continuation of the protrusion and groove between adjacent panels and allows for sliding wedging interfit between adjacent panels either endwise or sidewise.

The interior surface of each rail of the embodiment shown in FIGS. 12–15 is provided with transversely spaced notches 120 and 121 which are the same size as the face sheet thicknesses and provide lateral support for the face sheets as well as support against movement in the plane of the sheets. As in the preferred embodiments, studs or spacers 123 are also added for additional strength and for supporting the face sheets along their length. In addition, the preferred panel unit 100 is filled with a insulating material such as polyurethane foam.

The second embodiment panel is used in the same manner as the first embodiment panel but without locking keys and provides better insulative value and less expensive manufacturing costs. The description of use in a building will be eliminated since the principles already described for the first embodiment are equally applicable to the second embodiment.

The panel unit 100 forms the basic building block for vertical side walls of the structure and will be provided in generally 4×8 feet dimensions, however, smaller units such as 2×8 feet panels may also be used for versatility. A third embodiment panel 130 is shown in FIGS. 18–20 FIGS. 19 are isometrics turned 45° similar to FIGS. 14. This panel unit is used for horizontal floors or horizontal or sloping roofs. Generally, these panels will also be in 2×8 feet or 4×8 feet dimensions also. The panels 130 each include a set of side rails 131 and 132 and identical end rails 133 and 134. The end rails and side rails are turned end-for-end relative to one another as in the panel unit 100. Similarly, face sheets 136 and 137 are joined to the rails which in turn are joined to one another by suitable fasteners and bonding.

As is readily apparent in the embodiment of FIGS. 18–20, each of the rails includes a protusion 139 and a recess or groove 140. The side rails are turned end-for-end relative to one another as are the end rails. Accordingly, as in the embodiment shown in FIGS. 12–15 and in the earliest disclosed embodiment, the protrusion 139 of side rail 131 is shortened along its length to end flush with the groove 140 of the end rail 134. Similarly, the protusion 139 of side rail 132 has a shortened length to end flush with the groove 140 of end rail 133.

Screws 142 or other suitable fasteners hold the side rails and end rails together along with staples, not shown, which secure the face sheets 136 and 137 to the rails. In addition, the face sheets and the rails can be bonded together to form the structural integral panel unit. That is, the panel unit is a structral entity in itself, a load supporting component of the total building, as in the earlier described embodiments suitable to be used and is used as a substitute for roof joists, floor joists and rafters.

Figure 17:
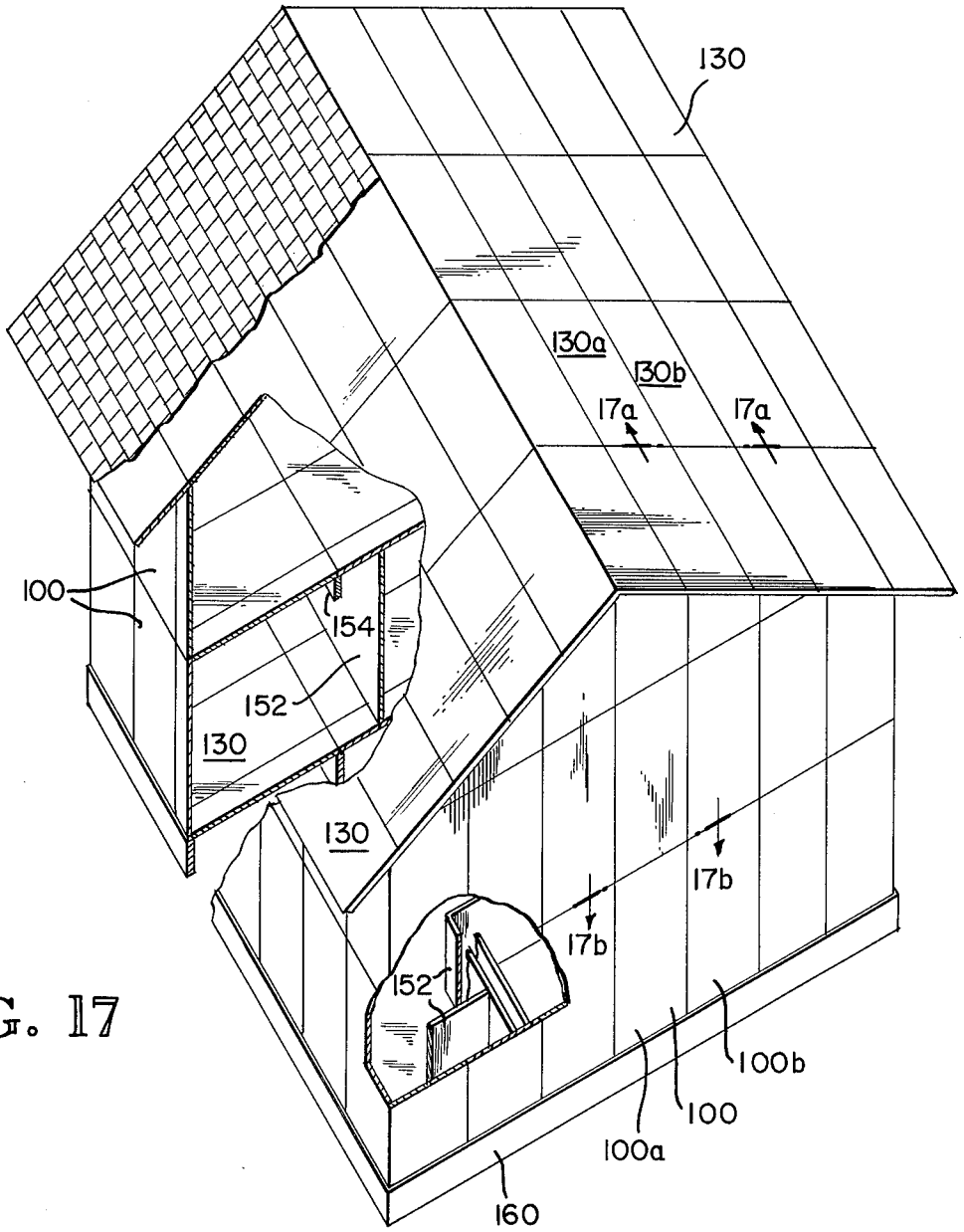
FIG. 17 is an isometric of a typical building constructed of second and third embodiment panels of this invention and with parts broken away for clarity.
Figure 17A:
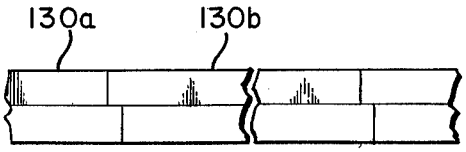
FIGS. 17*a* and 17*b* are fragmentary elevations showing two interconnected third embodiment roof panels and second embodiment wall panels, respectively.
Figure 17B:
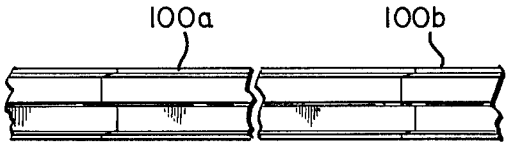

FIGS. 16 and 17 illustrate a complete building formed of the unique panel units. For example, FIG. 16 illustrates a roof and combined joints formed of panel units 130 of the type illustrated in FIGS. 18–20. Panel units 100 of the type shown in FIGS. 12–15 are used in each of the various stories of the building as the side wall and interior wall components. The panel units 130 are also carried out throughout the building as ceiling and floor components. These ceiling and floor components with their unique end rail constructions overlap as at joint 150, for example, to provide a positive mechanical interconnection between the panel units which may be securely tied together through the use of nails or screws 151. An exterior view of the building with parts broken away, shows roof panels and floor panels 130 combined with the panel units 100 resting on a foundation 160 of conventional construction. Similarly, non-structural curtain walls or structural walls within the building 152 may be used for room division and if a room division does not end beneath a joint 150, a beam 154 is employed to support the joint.

As is readily apparent, the further use of the third embodiment panel units combined with the panel units of either the first or second embodiments illustrated enables essentially all of the individual structural elements of the building to be premanufactured with structural integrity so that the entire two-story building can be assembled at the building site in a minimum amount of time and with a minimum amount of labor. If desired, window units, door units, plumbing, etc., can all be manufactured into the various panels with the architect or builder having the option to choose from a variety of such panels in designing the house to the needs of the owner. Exacting carpentry as is required during conventional building construction is eliminated since the tolerances in the panel units are accurately determined during manufacture. Thus the ultimate cost of construction has only a minimal amount of expensive carpenter labor involved. Finally, the entire house with only a minimal amount of conventional construction supplies can be packaged and shipped over long distances and quickly erected at the building site.

One additional unique feature is made possible by the combined structural wall and floor panels. Conventional housing construction lays the wall studding on a plate direclty over the floor joists thus fixing the vertical position of the floor to the bottom of a wall. In this invention the floors and walls are separately integral structural components. As a result, the floor panels can be easily arranged to be secured to beams hung from the wall panels and thus positioned at any desired vertical location along the panels. Applications of this principle could allow easily arranged first or upper story ceilings that are of a height less than the standard generally 8 foot ceiling now in conventional housing construction. For example, lower ceilings could be provided for shorter races of people or for storage areas to save construction cost and heat loss. FIG. 16 illustrates how floor panels 130 are locked to the sidewall panels 100 in one embodiment, however, as is obvious, beams 154 could be attached around the interior side wall panels at lower locations and the floor panels abutted against the side wall panels as illustrated but resting on the beams. Wall spacing would become less flexible but this would be more than compensated for by the increased vertical floor height flexibility.

The embodiments of the invention in which a particular property or privilege is claimed are defined as follows:

1. A structural panel assembly comprising:

two parallel face sheets;

a rigid rectangular border frame surrounding said sheets and having top and bottom rails interconnected by side rails, all of said rails having the same transverse cross-section but with said side rails turned end-for-end relative to one another and with said top and bottom rails also turned end-for-end relative to one another so that the top rail and a first of the side rails have one cross-sectional orientation and the bottom rail and the second side rail have the opposite cross-sectional orientation, said cross-section being so shaped that like border frames juxtaposed side against side will interfit at the sides by sliding engagement along a plane parallel to the longitudinal planes of said face sheets, each said rail having an outwardly extending protrusion and a groove lying along said protrusion, said protrusion having a head wall and a pair of inner and outer outwardly converging sidewalls, said groove having a base wall and a pair of inner and outer outwardly diverging sidewalls, each rail having a bevel cut at the one end face where the cross-sectional orientation is the same as that of the adjoining rail to form a respective bevel joint, the other end face of two of said rails being formed by a right angle cut through both the groove and protrusion cross-sections, and each of the other two of the rails having its other end formed with a right angle cut through its groove base wall in the plane of the head wall of the adjoining rail for overlapping the right angle cut end of the protrusion of such adjoining rail and having its protrusion cut back lengthwise to the plane of the base wall of the groove of such adjoining rail by a cutback matching the cross-section of such groove; and means for securing the face sheets to the border frame.

2. A structural panel assembly according to claim 1 in which the outer sidewall of the groove of each rail merges with an outer shoulder, and the outer sidewall of the protrusion of each rail merges with an outer ledge which is substantially coplanar with the base wall of the groove.

3. A structural panel assembly according to claim 2 in which said shoulder occupies a plane spaced toward the base wall of the groove from the plane of the head wall of the protrusion.

4. A structural panel assembly according to claim 2 in which the side of each rail opposite from the side presenting the protrusion and the groove has respective outer longitudinal notches located opposite said shoulder and ledge, the outer border portions of said sheets being seated in respective of said notches.

* * * * *